US009051847B2

(12) United States Patent
Aiello et al.

(10) Patent No.: US 9,051,847 B2
(45) Date of Patent: Jun. 9, 2015

(54) FLOATING SEGMENTED SEAL

(75) Inventors: Nicholas Aiello, New Haven, CT (US); Conor Lee, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 395 days.

(21) Appl. No.: 13/484,315

(22) Filed: May 31, 2012

(65) Prior Publication Data

US 2013/0319005 A1 Dec. 5, 2013

(51) Int. Cl.
*F01D 11/02* (2006.01)
*F01D 11/00* (2006.01)

(52) U.S. Cl.
CPC ..... *F01D 11/02* (2013.01); *F01D 11/001* (2013.01)

(58) Field of Classification Search
CPC ..... F01D 11/00; F01D 11/001; F01D 11/003; F01D 11/005; F01D 5/02; F01D 5/021; F01D 5/046; F01D 5/06
USPC ..... 60/796, 805; 415/173.3, 173.4, 174.4
See application file for complete search history.

(56) References Cited

U.S. PATENT DOCUMENTS

| | | | | |
|---|---|---|---|---|
| 6,226,975 | B1 | 5/2001 | Ingistov | |
| 6,622,490 | B2 | 9/2003 | Ingistov | |
| 7,465,152 | B2 | 12/2008 | Nigmatulin | |
| 7,578,653 | B2 | 8/2009 | Klasing et al. | |
| 8,066,473 | B1 | 11/2011 | Aho, Jr. | |
| 8,152,450 | B1 | 4/2012 | Aho | |
| 2007/0059158 | A1* | 3/2007 | Alvanos et al. | 415/115 |
| 2008/0260522 | A1* | 10/2008 | Alvanos | 415/173.4 |
| 2008/0260523 | A1* | 10/2008 | Alvanos et al. | 415/173.4 |
| 2008/0267769 | A1* | 10/2008 | Schwarz et al. | 415/148 |
| 2009/0148295 | A1* | 6/2009 | Caprario et al. | 416/193 A |
| 2012/0039707 | A1 | 2/2012 | Rose et al. | |

OTHER PUBLICATIONS

International Search Report and Written Opinion for International Application No. PCT/US2013/041496 completed on Mar. 2, 2014.
International Preliminary Report on Patentability for International Application No. PCT/US2013/041496 mailed Dec. 11, 2014.

* cited by examiner

*Primary Examiner* — Phutthiwat Wongwian
*Assistant Examiner* — Marc J Amar
(74) *Attorney, Agent, or Firm* — Carlson, Gaskey & Olds, PC

(57) ABSTRACT

A rotor body ledge defines a radially inner surface. A hub extends axially from the rotor, and has a radially outer surface spaced from the ledge radially inner surface. A first distance is defined between the radially inner surface of the ledge and the radially outer surface of the hub. A knife edge seal has at least one pointed knife seal portion at a radially outer end. A radially inwardly extending arm portion extends from the seal, and an axially inwardly extending portion extends axially inwardly from the radially inwardly extending portion. The axially inwardly extending portion has a radially outer face and a radially inner face, which are spaced by a second distance. The second distance is less than the first distance, such that the knife edge seal is free floating between the ledge and the hub.

17 Claims, 2 Drawing Sheets

FLOATING SEGMENTED SEAL

BACKGROUND

This application relates to a floating knife edge seal for use in a turbine engine.

Gas turbine engines are known, and typically include a fan delivering air into a compressor section. The air is compressed and delivered downstream into a combustion section where it is mixed with fuel and ignited. Products of the combustion pass downstream over turbine rotors causing them to rotate.

The compressor and turbine sections both include a plurality of rotors carrying blades having airfoils. Static vanes are typically positioned intermediate rows of the blades.

It is a desire of gas turbine engine designers to ensure that all gas flow be directed across the blades and vanes, and that leakage inwardly or outwardly of these structures be minimized. Thus, seals are typically provided. One location for a seal would be between a rotor, and at the location of the static vane. One particular type of seal is a knife edge seal. A knife edge seal typically includes one or more pointed seal members that are spaced from a static seal surface that may include abradable material.

Typically, the knife edge seals have been snap or otherwise interference fit into a position locking them to rotate with the rotor. This has sometimes raised concerns with stresses, as the rotor hub flexes.

SUMMARY

In one featured embodiment, a gas turbine engine rotor section has a rotor body with a ledge extending axially from a location on the rotor body. The ledge defines a radially inner surface radially inwardly of the ledge, and a hub extending axially from the rotor, and beyond the ledge. The hub has a radially outer surface spaced from the ledge radially inner surface. A first distance is defined between the radially inner surface of the ledge and the radially outer surface of the hub. A knife edge seal has at least one pointed knife seal portion at a radially outer end, a radially inwardly extending arm, and an axially inwardly extending portion extending axially inwardly from the radially inwardly extending arm. The axially inwardly extending arm has a radially outer face and a radially inner face. The radially inner and radially outer faces of the knife edge seal are spaced by a second distance, with the second distance being less than the first distance. The axially inwardly extending portion is received between the radially inner surface of the rotor and the radially outer surface of the hub, such that the knife edge seal is free floating between the ledge and hub.

In another embodiment according to the previous embodiment, the axially inwardly extending portion extends axially inwardly to a radially inwardly extending lip. The radially inwardly extending lip is received in a space defined between the hub and rotor.

In another embodiment according to any of the previous embodiments, the space is axially between a portion of the hub and a portion of the rotor.

In another embodiment according to any of the previous embodiments, there are a plurality of knife edge seal portions.

In another embodiment according to any of the previous embodiments, the rotor is a compressor rotor.

In another embodiment according to any of the previous embodiments, the rotor is a turbine rotor In another featured embodiment, a compressor section for a gas turbine engine has a plurality of stages, each carrying a plurality of blades, with at least one of the stages including a rotor body which has a ledge extending axially from a location on the rotor body. The ledge defines a radially inner surface radially inwardly of the ledge, and a hub extending axially from the rotor, and beyond the ledge. The hub has a radially outer surface spaced from the ledge radially inner surface. A first distance is defined between the radially inner surface of the ledge and the radially outer surface of the hub. A knife edge seal has a plurality of pointed knife seal portions at a radially outer end, a radially inwardly extending arm, and an axially inwardly extending portion extending axially inwardly from the radially inwardly extending arm. The axially inwardly extending arm has a radially outer face and a radially inner face. The radially inner and radially outer faces of the knife edge seal are spaced by a second distance, with the second distance being less than the first distance, and the axially inwardly extending portion being received between the radially inner surface of the rotor and the radially outer surface of the hub, such that the knife edge seal is free floating between the ledge and hub. The axially inwardly extending portion extends axially inwardly to a radially inwardly extending lip. The radially inwardly extending lip is received in a space defined between the hub and the rotor. The space is axially between a portion of the hub and a portion of the rotor.

In another featured embodiment, a gas turbine engine has a compressor, a combustor and a turbine section. The compressor and turbine sections each have a plurality of stages carrying a plurality of blades, with at least one of the stages in one of the compressor and turbine sections including a rotor body having a ledge extending axially from a location on the rotor body. The ledge defines a radially inner surface radially inwardly of the ledge, and a hub extending axially from the rotor, and beyond the ledge. The hub has a radially outer surface spaced from the ledge radially inner surface. A first distance is defined between the radially inner surface of the ledge and the radially outer surface of the hub. A knife edge seal has at least one pointed knife seal portion at a radially outer end, a radially inwardly extending arm, and an axially inwardly extending portion extending axially inwardly from the radially inwardly tending portion. The axially inwardly extending portion has a radially outer surface and a radially inner surface. The radially inner and radially outer surfaces of the knife edge seal are spaced by a second distance, with the second distance being less than the first distance, and the axially inwardly extending portion received between the radially inner surface of the rotor and the radially outer surface of the hub, such that the knife edge seal is free floating between the ledge and hub.

In another embodiment according to any of the previous embodiments, the axially inwardly extending portion extends axially inwardly to a radially inwardly extending lip/The radially inwardly extending lip is received in a space defined between the hub and the rotor.

In another embodiment according to any of the previous embodiments, the space is axially between a portion of the hub and a portion of the rotor.

In another embodiment according to any of the previous embodiments, there are a plurality of knife edge seal segments.

In another embodiment according to any of the previous embodiments, there are a plurality of knife edge seal segments.

In another embodiment according to any of the previous embodiments, the axially inwardly extending portion extends axially inwardly to a radially inwardly extending lip. The radially inwardly extending lip is received in a space defined between the hub and the rotor.

In another embodiment according to any of the previous embodiments, the space is axially between a portion of the hub and a portion of the rotor.

In another embodiment according to any of the previous embodiments, there are a plurality of knife edge seal segments.

In another embodiment according to any of the previous embodiments, there are a plurality of knife edge seal segments.

In another embodiment according to any of the previous embodiments, there are at least two turbine rotors. The plurality of compressor rotors include a low pressure compressor and a high pressure compressor. One of the turbine rotors drives each of the low and high pressure compressor rotors.

In another embodiment according to any of the previous embodiments, one of the turbine and compressor sections is the turbine section.

In another embodiment according to any of the previous embodiments, one of the turbine and compressor sections is the compressor section.

These and other features of this application will be best understood from the following specification and drawings, the following of which is a brief description.

DETAILED DESCRIPTION

Figure 1:
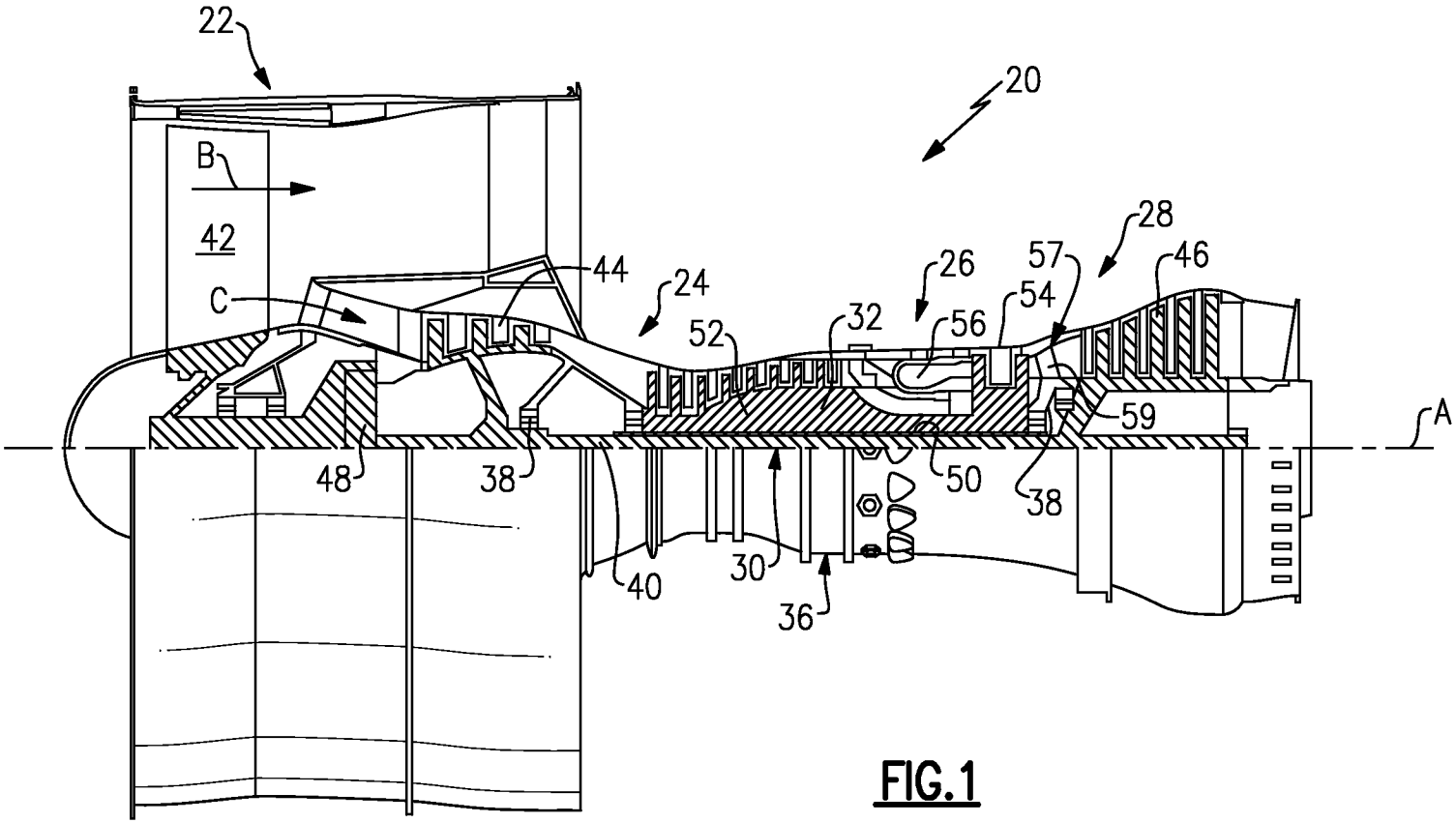
FIG. 1 shows a standard gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C for compression into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFCT')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tambient deg R)/518.7)^0.5]. The "Low corrected fan tip speed" as disclosed herein according to one non-limiting embodiment is less than about 1150 ft/second.

Figure 2:
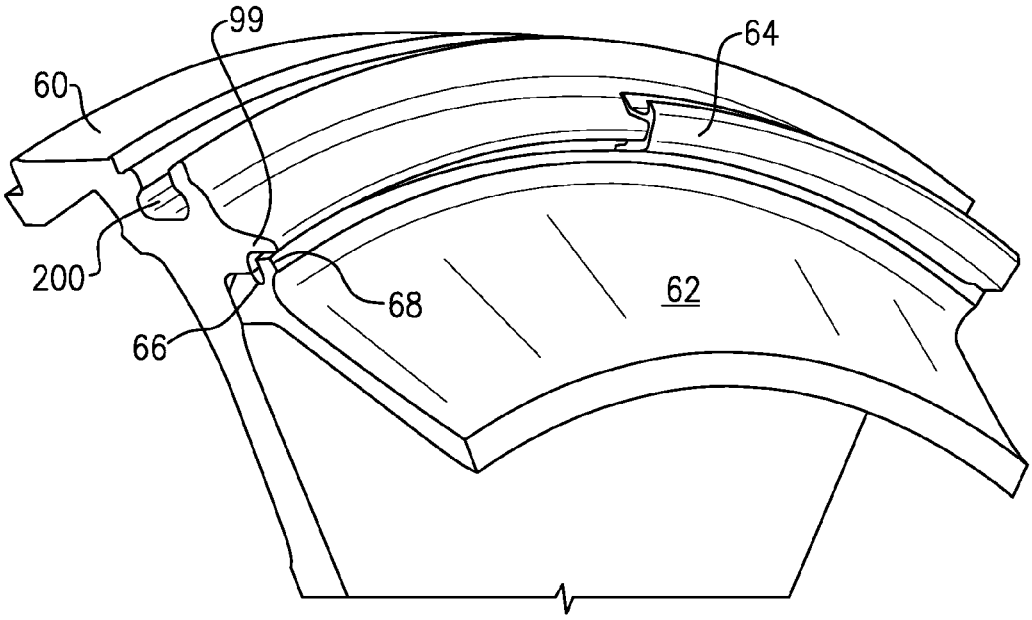
FIG. 2 shows a portion of a compressor rotor and seal.

FIG. 2 shows a portion of a compressor rotor 60. A slot 200 receives blades, as known. As shown, a hub 62 extends between the rotor 60, and may extend to the next downstream rotor. However, in one embodiment, the hub 62 extends radially inwardly and abuts a portion of a tie shaft. In this embodiment, the rotor 60 may be the most downstream compressor rotor.

Segmented seal segment 64 is mounted in a space between a ledge 99 on the rotor 60, and a portion 68 of the hub 62. A space 66 is formed within the hub at a location adjacent to the rotor 60, and beneath the ledge 99. The knife edge seal segment 64 may be formed of materials as have typically been utilized to form a knife edge seal.

Figure 3:
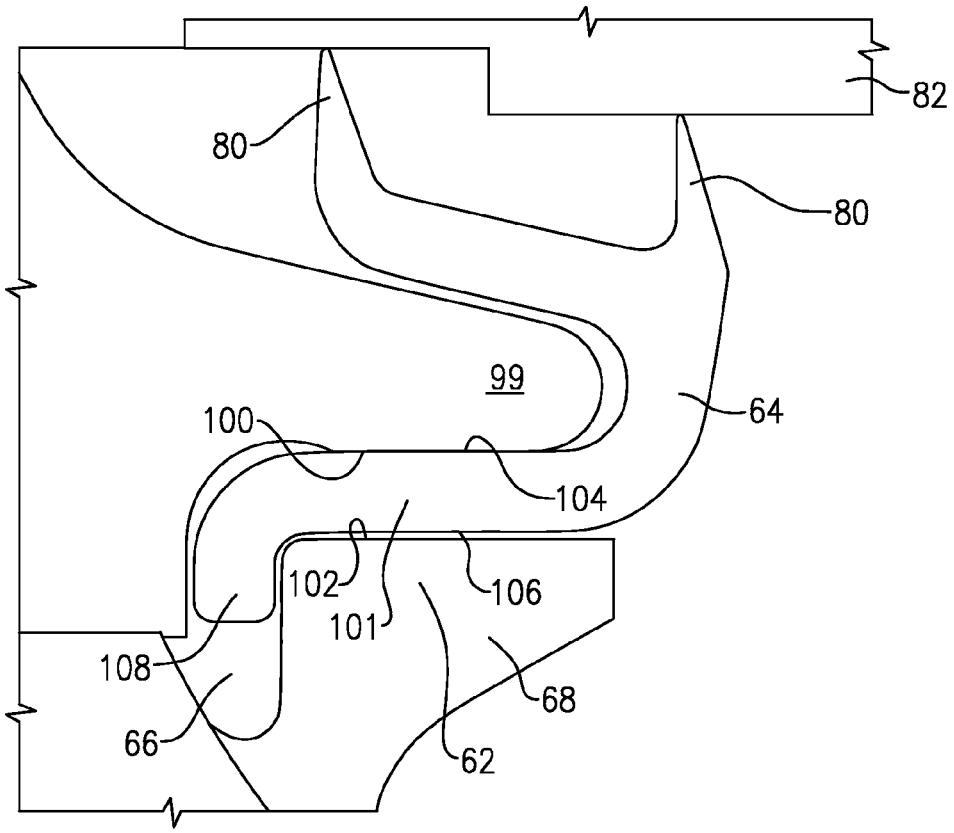
FIG. 3 shows a detail of the seal.

As shown in FIG. 3, the knife edge seal 64 has the knife edge portions 80 facing an abradable seal material 82. Abradable seal material 82 may be associated with a static location in the compressor section, such as associated with a radially inner portion of a vane.

The seal 64 has an inwardly extending portion 101 defining an outer face 104 and an inner face 106. As is clear from FIG. 3, the distance between faces 104 and 106 is less than the distance between an outer face 102 of the portion 68 of the hub 62, and an inner face 100 of the rotor ledge 99. Thus, the seal is free to flow between these two members, as the rotor or hub flex during operation. A radially inwardly extending inner lip 108 is received within the space 66.

The seal is thus able to float, and will not bind nor transmit stresses between the hub and rotor.

While a single segment 64 is illustrated in FIG. 2, it should be understood there may be a plurality of circumferentially adjacent segments 64. Also, the rotor and hub of a turbine section may also benefit with a seal as disclosed.

Although an embodiment of this invention has been disclosed, a worker of ordinary skill in this art would recognize that certain modifications would come within the scope of this invention. For that reason, the following claims should be studied to determine the true scope and content of this invention.

We claim:

1. A gas turbine engine rotor section comprising:

a rotor body, said rotor body having a ledge extending axially from a location on said rotor body;

said ledge defining a radially inner surface radially inwardly of said ledge, and a hub extending axially from said rotor, said hub extending to a downstream rotor body, and beyond said ledge, said hub having a radially outer surface spaced from said ledge radially inner surface, and a first distance defined between said radially inner surface of said ledge and said radially outer surface of said hub; and a knife edge seal, said knife edge seal having at least one pointed knife seal portion at a radially outer end, a radially inwardly extending arm, and an axially inwardly extending portion extending axially inwardly from said radially inwardly extending arm, said axially inwardly extending portion having a radially outer face and a radially inner face, and said radially inner and radially outer faces of said knife edge seal being spaced by a second distance, with said second distance being less than said first distance, and said axially inwardly extending portion being received between said radially inner surface of said rotor and said radially outer surface of said hub, such that said knife edge seal is free floating between said ledge and said hub.

2. The gas turbine engine rotor section as set forth in claim 1, wherein said axially inwardly extending portion extends axially inwardly to a radially inwardly extending lip, said radially inwardly extending lip being received in a space defined between said hub and said rotor.

3. The gas turbine engine rotor section as set forth in claim 2, wherein said space being axially between a portion of said hub and a portion of said rotor.

4. The gas turbine engine rotor section as set forth in claim 1, wherein there are a plurality of knife edge seal portions.

5. The gas turbine engine rotor section of claim 1, wherein said rotor is a compressor rotor.

6. A gas turbine engine rotor section of claim 1, wherein said rotor is a turbine rotor.

7. A compressor section for a gas turbine engine comprising:

a plurality of stages, each carrying a plurality of blades, with at least one of said stages including a rotor body, said rotor body having a ledge extending axially from a location on said rotor body;

said ledge defining a radially inner surface radially inwardly of said ledge, and a hub extending axially from said rotor, said hub extending to a rotor body of a downstream stage, and beyond said ledge, said hub having a radially outer surface spaced from said ledge radially inner surface, and a first distance defined between said radially inner surface of said ledge and said radially outer surface of said hub;

a knife edge seal, said knife edge seal having a plurality of pointed knife seal portions at a radially outer end, a radially inwardly extending arm, and an axially inwardly extending portion extending axially inwardly from said radially inwardly extending arm, said axially inwardly extending portion having a radially outer face and a radially inner face, and said radially inner and radially outer faces of said knife edge seal being spaced by a second distance, with said second distance being less than said first distance, and said axially inwardly extending portion being received between said radially inner surface of said rotor and said radially outer surface of said hub, such that said knife edge seal is free floating between said ledge and said hub; and said axially inwardly extending portion extends axially inwardly to a radially inwardly extending lip, said radially inwardly extending lip being received in a space defined between said hub and said rotor, said space being axially between a portion of said hub and a portion of said rotor.

8. A gas turbine engine comprising:

a compressor;

a combustor and a turbine section, with said compressor and turbine sections each including a plurality of stages carrying a plurality of blades, with at least one of said stages in one of said compressor and turbine sections including a rotor body, said rotor body having a ledge extending axially from a location on said rotor body;

said ledge defining a radially inner surface radially inwardly of said ledge, and a hub extending axially from said rotor, said hub extending to a rotor body of a downstream stage, and beyond said ledge, said hub having a radially outer surface spaced from said ledge radially inner surface, and a first distance defined between said radially inner surface of said ledge and said radially outer surface of said hub; and a knife edge seal, said knife edge seal having at least one pointed knife seal portion at a radially outer end, a radially inwardly extending arm, and an axially inwardly extending portion extending axially inwardly from said radially inwardly tending portion, said axially inwardly extending portion having a radially outer surface and a radially inner surface, and said radially inner and radially outer surfaces of said knife edge seal being spaced by a second distance, with said second distance being less than said first distance, and said axially inwardly extending portion being received between said radially inner surface of said rotor and said radially outer surface of said hub, such that said knife edge seal is free floating between said ledge and said hub.

9. The gas turbine engine as set forth in claim 8, wherein said axially inwardly extending portion extends axially inwardly to a radially inwardly extending lip, said radially inwardly extending lip being received in a space defined between said hub and said rotor.

10. The gas turbine engine as set forth in claim 9, wherein said space being axially between a portion of said hub and a portion of said rotor.

11. The gas turbine engine as set forth in claim 10, wherein there are a plurality of knife edge seal segments.

12. The gas turbine engine as set forth in claim 8, wherein there are a plurality of knife edge seal segments.

13. The gas turbine engine as set forth in claim 12, wherein said axially inwardly extending portion extends axially inwardly to a radially inwardly extending lip, said radially inwardly extending lip being received in a space defined between said hub and said rotor.

14. The gas turbine engine as set forth in claim 12, wherein said space being axially between a portion of said hub and a portion of said rotor.

15. The gas turbine engine as set forth in claim 14, wherein there are a plurality of knife edge seal segments.

16. The gas turbine engine as set forth in claim 8, wherein said one of said turbine and compressor sections is said turbine section.

17. The gas turbine engine as set forth in claim 8, wherein said one of said turbine and compressor sections is said compressor section.

* * * * *